US011337289B2

(12) United States Patent
Carre et al.

(10) Patent No.: US 11,337,289 B2
(45) Date of Patent: May 17, 2022

(54) SYSTEM AND METHOD FOR CONTROLLING OUTPUT OF A DYNAMIC LIGHTING SCENE BY A GROUP OF LIGHTING UNITS

(71) Applicant: SIGNIFY HOLDING B.V., Eindhoven (NL)

(72) Inventors: Antonin Carre, Hong Kong (CN); Ganesh Kumar Gurung, Hong Kong (CN); Jean-Philippe Gal, Hong Kong (CN)

(73) Assignee: SIGNIFY HOLDING B.V., Eindhoven (NL)

( * ) Notice: Subject to any disclaimer, the term of this patent is extended or adjusted under 35 U.S.C. 154(b) by 67 days.

(21) Appl. No.: 16/641,374

(22) PCT Filed: Aug. 23, 2017

(86) PCT No.: PCT/CN2017/098654
§ 371 (c)(1),
(2) Date: Feb. 24, 2020

(87) PCT Pub. No.: WO2019/036934
PCT Pub. Date: Feb. 28, 2019

(65) Prior Publication Data
US 2020/0196425 A1 Jun. 18, 2020

(51) Int. Cl.
*H05B 47/155* (2020.01)
*H05B 47/19* (2020.01)
(Continued)

(52) U.S. Cl.
CPC ..... *H05B 47/155* (2020.01); *H05B 47/16* (2020.01); *H05B 47/165* (2020.01); *H05B 47/19* (2020.01)

(58) Field of Classification Search
None
See application file for complete search history.

(56) References Cited

U.S. PATENT DOCUMENTS 5,924,784 A * 7/1999 Chliwnyj ..... F21V 3/04 362/234
6,166,496 A * 12/2000 Lys ..... H05B 47/18 315/316
(Continued)

FOREIGN PATENT DOCUMENTS

CN 103607823 A 2/2014
CN 103987176 A 8/2014
(Continued)

*Primary Examiner* — Srinivas Sathiraju

(57) ABSTRACT

A system for controlling output of a dynamic lighting scene by a first and a second lighting unit within a common lighting area, the system comprising: at least one memory store module for storing a data code sequence representing pre-defined lighting characteristics associated with a plurality of sequential steps of the dynamic lighting scene; at least one processor module configured for processing the data code sequence to determine from the data code sequence the lighting characteristics associated with the plurality of steps; and each of said first and second lighting units comprising an illumination module configured for outputting the lighting characteristics associated with the plurality of steps of the dynamic lighting scene as determined by the at least one processor module, and wherein, the illumination modules of the first and second lighting units are configured for outputting the lighting characteristics of the plurality of steps of the dynamic lighting scene in a substantially non-synchronous manner.

10 Claims, 5 Drawing Sheets

(51) Int. Cl.
*H05B 47/16* (2020.01)
*H05B 47/165* (2020.01)

(56) References Cited

U.S. PATENT DOCUMENTS 6,577,080 B2 * 6/2003 Lys ..... H05B 45/38 315/362
7,038,398 B1 * 5/2006 Lys ..... B60Q 3/80 315/291
7,231,060 B2 * 6/2007 Dowling ..... H04S 5/005 382/100
9,959,717 B2 * 5/2018 Thornton ..... G08B 7/066
10,820,395 B2 * 10/2020 Kastee ..... H05B 47/105
2001/0033488 A1 * 10/2001 Chliwnyj ..... F21S 10/04 362/231
2002/0171365 A1 * 11/2002 Morgan ..... H05B 47/10 315/56
2003/0057887 A1 * 3/2003 Dowling ..... H05B 47/175 315/291
2003/0072154 A1 * 4/2003 Moore ..... H05B 45/44 362/234
2005/0047134 A1 * 3/2005 Mueller ..... G02B 27/0994 362/231
2006/0176693 A1 * 8/2006 Walter ..... H05B 45/20 362/231
2006/0208666 A1 * 9/2006 Johnson ..... H05B 45/10 315/294
2006/0273741 A1 * 12/2006 Stalker, III ..... H05B 45/20 315/291
2010/0109564 A1 * 5/2010 Shin ..... H05B 45/20 315/294
2011/0057582 A1 * 3/2011 Sekulovski ..... H05B 47/155 315/312
2012/0206050 A1 * 8/2012 Spero ..... F21S 41/147 315/152
2015/0069930 A1 * 3/2015 Slot ..... H05B 45/12 315/293
2018/0279452 A1 * 9/2018 Gal ..... H05B 47/19
2018/0368237 A1 * 12/2018 Gal ..... H05B 47/16
2018/0368238 A1 * 12/2018 Gal ..... H04L 12/2807
2019/0021155 A1 * 1/2019 Van De Sluis ..... H05B 45/30
2019/0348000 A1 * 11/2019 Chen ..... G09G 5/10
2019/0350063 A1 * 11/2019 Chen ..... H05B 47/10
2020/0196425 A1 * 6/2020 Carre ..... H05B 47/19
2021/0153318 A1 * 5/2021 Alexander ..... G06F 3/041

FOREIGN PATENT DOCUMENTS

CN 106170168 A 11/2016
WO 2016194311 A1 12/2016

* cited by examiner

SYSTEM AND METHOD FOR CONTROLLING OUTPUT OF A DYNAMIC LIGHTING SCENE BY A GROUP OF LIGHTING UNITS

CROSS-REFERENCE TO PRIOR APPLICATIONS

This application is the U.S. National Phase application under 35 U.S.C. § 371 of International Application No. PCT/CN2017/098654. These applications are hereby incorporated by reference herein.

TECHNICAL FIELD

The present invention relates to lighting devices, systems and methods for providing dynamic lighting scenes.

BACKGROUND OF THE INVENTION

Modern day lighting devices such as lamps, luminaires and the like are controllable by a user to output a variety of dynamic lighting scenes which are intended to provide both an aesthetically pleasing decoration for a room and a feeling of well-being for the user. A dynamic lighting scene will typically comprise a sequence of predefined sequential "steps" and transitions between steps with each step and transition being defined by a different combination of colour temperature components (e.g. RGB components), white light components, dimming characteristics, and other light emission characteristics that are output by the lighting devices. Conventionally, as the predefined sequence of steps of a dynamic lighting scene are output in a continuous cycle by the lighting devices to produce the dynamic lighting effect, this is perceived by some users to give rise to a sense of predictability and repetitiveness. Accordingly, there is a perceived need to alleviate this existing problem.

SUMMARY OF THE INVENTION

The present invention seeks to alleviate at least one of the above-described problems.

The present invention may involve several broad forms. Embodiments of the present invention may include one or any combination of the different broad forms herein described.

In a first broad form, the present invention provides a system for controlling output of a dynamic lighting scene by a first and a second lighting unit within a common lighting area, the system comprising: at least one memory store module for storing a data code sequence representing pre-defined lighting characteristics associated with a plurality of sequential steps of the dynamic lighting scene; at least one processor module configured for processing the data code sequence to determine from the data code sequence the lighting characteristics associated with the plurality of steps; and each of said first and second lighting units comprising an illumination module configured for outputting the lighting characteristics associated with the plurality of steps of the dynamic lighting scene as determined by the at least one processor module, and wherein, the illumination modules of the first and second lighting units are configured for outputting the lighting characteristics of the plurality of steps of the dynamic lighting scene in a substantially non-synchronous manner.

Preferably, the illumination modules of the first and second lighting units may be configured for outputting the dynamic lighting scene commencing at different steps in the sequence of steps of the dynamic lighting scene.

Preferably, at least one of the illumination modules of the first and second lighting units may be configured for outputting the lighting characteristics associated with the steps in the sequence of steps of the dynamic lighting scene in a substantially randomised manner.

Preferably, (i) the illumination modules of the first and second lighting units may be configured to randomly skip over at least one of the steps in the sequence of steps of the dynamic lighting scene during outputting of the dynamic lighting scene; (ii) the illumination modules of the first and second lighting units may be configured to randomly vary the time duration of output of at least one of the steps in the sequence of steps of the dynamic lighting scene; and/or (iii) the illumination modules of the first and second lighting units may be configured to randomly vary the time duration of output of at least one transition between sequential steps of the dynamic lighting scene.

Preferably, at least a first and a second sequential step in the sequence of steps of the dynamic lighting scene may be associated together and wherein: (i) when the first step is randomly skipped over during outputting of the dynamic lighting scene, the illumination modules of the first and second lighting units are configured to also skip over output of the second sequential step associated with the first step; and, (ii) when the first step is randomly output during outputting of the dynamic lighting scene, the illumination modules of the first and second lighting units are configured to also output the second sequential step associated with the first step is also automatically output.

Preferably, the illumination modules of the first and second lighting units may include at least one of a coloured LED, a white light LED, and a brightness dimming module configured for outputting the lighting characteristics associated with the plurality of steps of the dynamic lighting scene.

Preferably, each of the first and second lighting units may comprise one of the at least one processor modules, and/or, wherein each of the first and second lighting units may comprise one of the at least one memory modules.

Preferably, the at least one memory module may be configured for storing a plurality of data code sequences each representing pre-defined lighting characteristics associated with a plurality of sequential steps of a plurality of different dynamic lighting scenes that are able to be outputted by the illumination modules of the first and second lighting units.

Preferably, the present invention may include a control unit configured for controlling the illumination modules of the first and second lighting units to selectably output one of the plurality of dynamic lighting scenes represented by one of the plurality of data code sequences stored in the at least one memory module.

Preferably, the control unit may be configured for controlling the illumination modules of the first and second lighting units by communicating a wireless control signal to at least one of the first and second lighting units via a wireless communication link, the wireless control signal including information indicative of one of the plurality of dynamic lighting scenes selected to be output.

In a second broad form, the present invention provides a method of controlling output of a dynamic lighting scene by a first and a second lighting unit within a common lighting area, the method comprising steps of: (i) storing a data code sequence representing pre-defined lighting characteristics associated with a plurality of sequential steps of the dynamic lighting scene in at least one memory module; (ii) using a processor module to process the data code sequence to determine from the data code sequence the lighting characteristics associated with the plurality of steps; and (iii) outputting the lighting characteristics associated with the plurality of steps of the dynamic lighting scene as determined by the at least one processor module via illumination modules of each of said first and second lighting unit; wherein, the illumination modules of the first and second lighting units are configured for outputting the lighting characteristics of the plurality of steps of the dynamic lighting scene in a substantially non-synchronous manner.

Preferably, the illumination modules of the first and second lighting units may be configured for outputting the dynamic lighting scene commencing at different steps in the sequence of steps of the dynamic lighting scene.

Preferably, at least one of the illumination modules of the first and second lighting units may be configured for outputting the lighting characteristics associated with the steps in the sequence of steps of the dynamic lighting scene in a substantially randomised manner.

Preferably, (i) the illumination modules of the first and second lighting units may be configured to randomly skip over at least one of the steps in the sequence of steps of the dynamic lighting scene during outputting of the dynamic lighting scene; (ii) the illumination modules of the first and second lighting units may be configured to randomly vary the time duration of output of at least one of the steps in the sequence of steps of the dynamic lighting scene; and/or (iii) the illumination modules of the first and second lighting units may be configured to randomly vary the time duration of output of at least one transition between sequential steps of the dynamic lighting scene.

Preferably, at least a first and a second sequential step in the sequence of steps of the dynamic lighting scene are associated together and wherein: (i) when the first step is randomly skipped over during outputting of the dynamic lighting scene, the illumination modules of the first and second lighting units are configured to also skip over output of the second sequential step associated with the first step; and, (ii) when the first step is randomly output during outputting of the dynamic lighting scene, the illumination modules of the first and second lighting units are configured to also output the second sequential step associated with the first step is also automatically output.

Preferably, the illumination modules of the first and second lighting units may include at least one of a coloured LED, a white light LED, and a brightness dimming module configured for outputting the lighting characteristics associated with the plurality of steps of the dynamic lighting scene.

Preferably, each of the first and second lighting units may comprise one of the at least one processor modules, and/or, wherein each of the first and second lighting units may comprise one of the at least one memory modules.

Preferably, the at least one memory module may be configured for storing a plurality of data code sequences each representing pre-defined lighting characteristics associated with a plurality of sequential steps of a plurality of different dynamic lighting scenes that are able to be outputted by the illumination modules of the first and second lighting units.

Preferably, the present invention may include a control unit configured for controlling the illumination modules of the first and second lighting units to selectably output one of the plurality of dynamic lighting scenes represented by one of the plurality of data code sequences stored in the at least one memory module.

Preferably, the control unit may be configured for controlling the illumination modules of the first and second lighting units by communicating a wireless control signal to at least one of the first and second lighting units via a wireless communication link, the wireless control signal including information indicative of one of the plurality of dynamic lighting scenes selected to be output.

In a third broad form, the present invention provides a lighting unit configured for use in accordance with any one of the first and/or second broad forms of the present invention.

Advantageously, the broad forms of the present invention may assist in providing a more immersive and pleasant visual rendering of the dynamic lighting scene as perceived by certain users compared to the relatively repetitive and predictable manner in which the sequential steps in dynamic lighting scenes are rendered by certain existing lighting systems.

BRIEF DESCRIPTION OF THE DRAWINGS

The present invention will become more fully understood from the following detailed description of a preferred but non-limiting embodiment thereof, described in connection with the accompanying drawings, wherein.

DETAILED DESCRIPTION OF THE PREFERRED EMBODIMENTS

Figure 4:
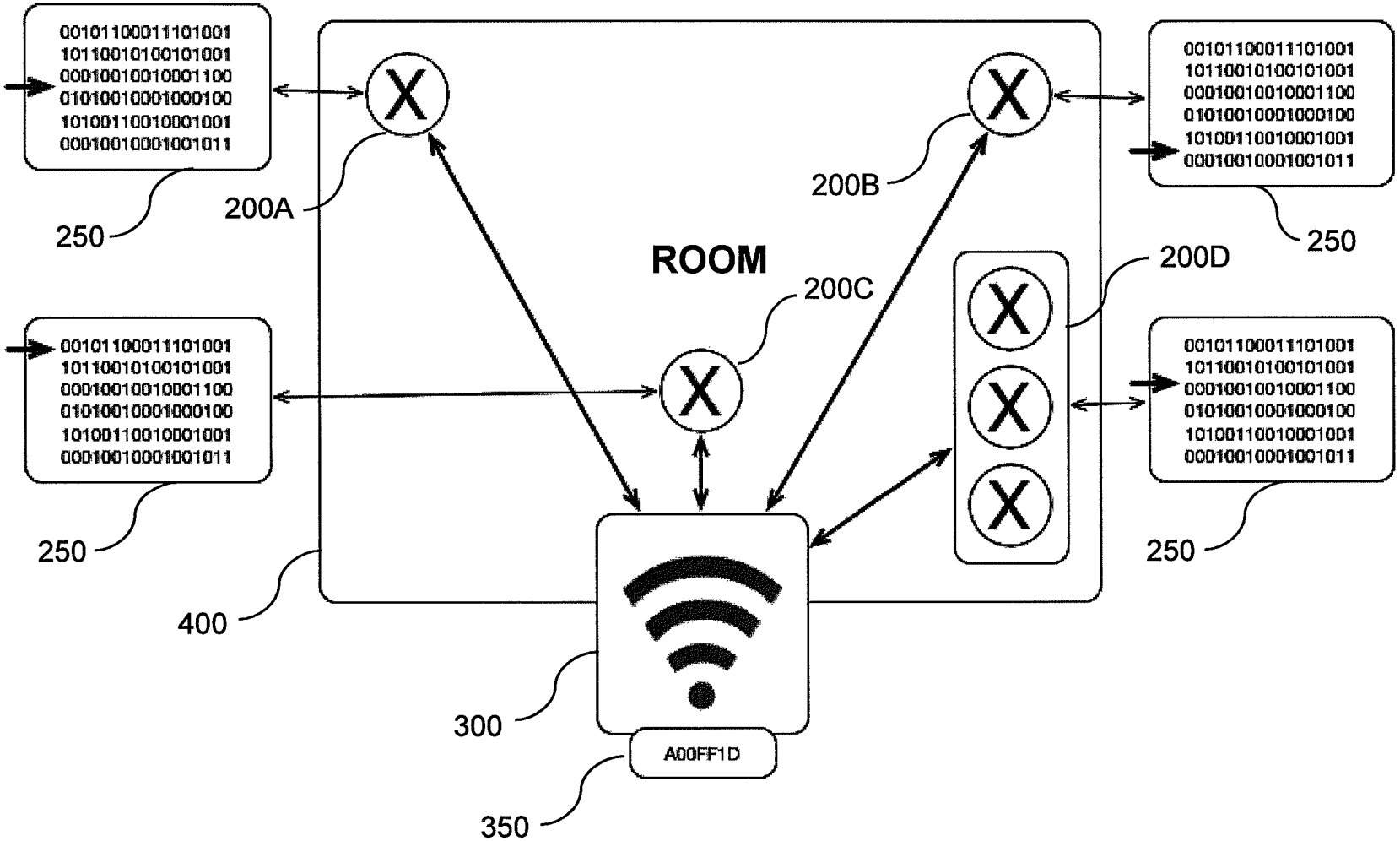
FIG. 4 shows an exemplary setup of a plurality of lighting units arranged in a common lighting area (e.g. a room of a building) and a control unit for controlling operation of the plurality of lighting units via a wireless communication link, in accordance with an embodiment of the present invention.

Preferred embodiments of the present invention will now be described with reference to the drawings FIGS. 1 to 6. Referring firstly to FIG. 4, a novel system is shown comprising a control unit and a plurality of lighting units (200A, 200B,200C,200D) that are, responsive to commands received from the control unit, configured to output a dynamic lighting scene in a non-synchronous and randomised manner for the purpose of creating an immersive and aesthetically pleasing experience for the user.

Figure 2:
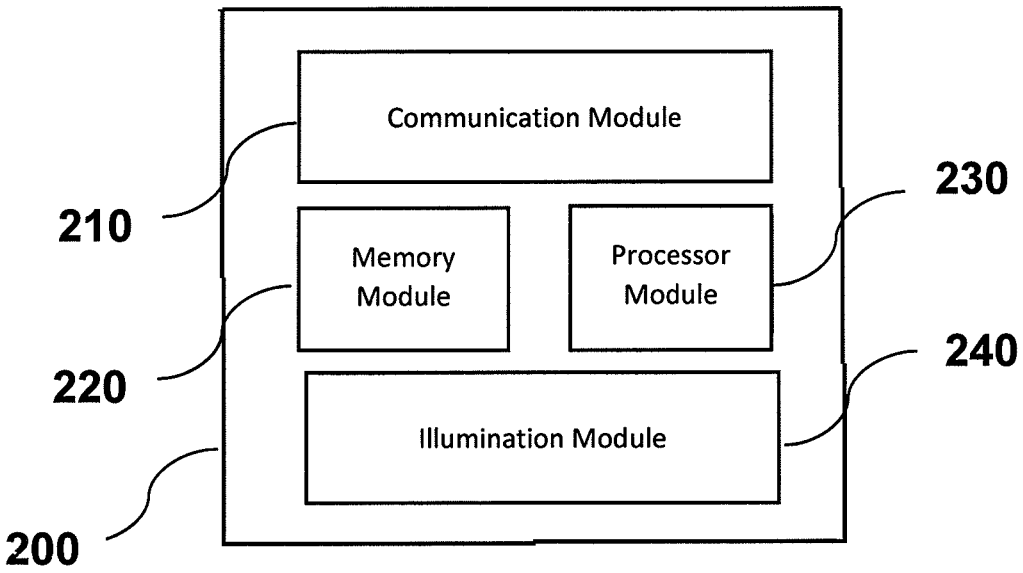
FIG. 2 shows a functional block diagram of a lighting unit used in accordance with an embodiment of the present invention.
Figure 3:
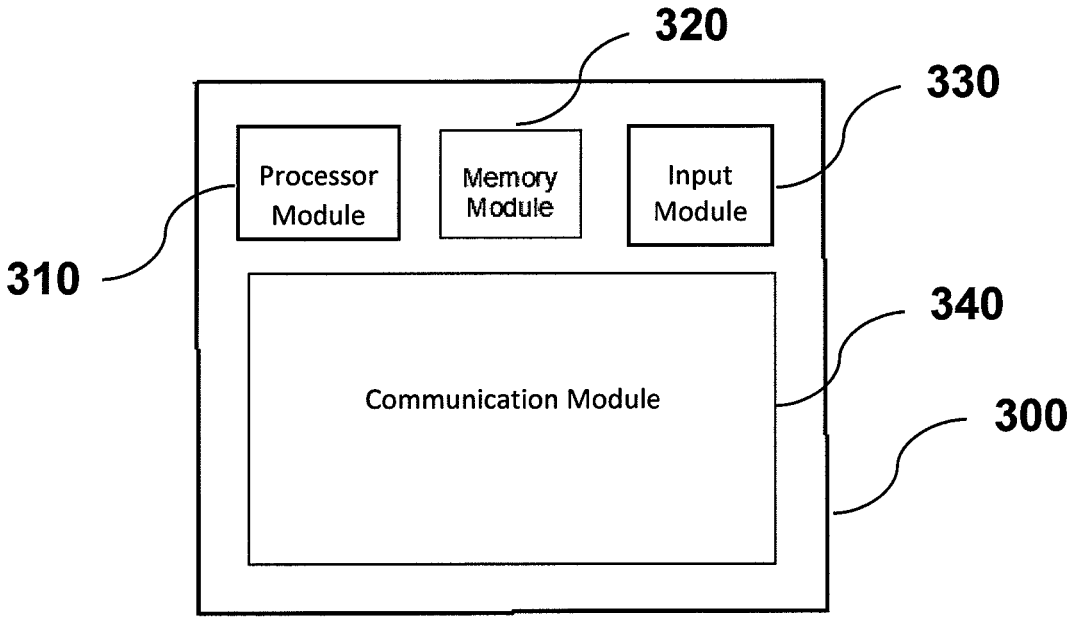
FIG. 3 shows a functional block diagram of a mobile electronic device serving as the user control unit in accordance with an embodiment of the present invention.

Each of the lighting units (200A,200B,200C.200D), are located in a common lighting area such as a room (400) of a building. FIG. 2 shows an exemplary functional block diagram of each of the lighting units (200A,200B,200C, 200D) which for ease of understanding of this embodiment are functionally identical in configuration and operation. The lighting units (200A, 200B, 200C.200D) each comprise a communication module (210) for wireless communicating with external devices such as the control unit (300), a memory module (220) for storing data code sequences and program code used to output at least one dynamic lighting scene, an illumination module (230) for outputting the steps of a dynamic lighting scene selected by the user, and, a processor module (240) for executing program code instructions stored in the memory module (220) to effect output of the at least one dynamic lighting scene. In alternate embodiments of the present invention it is possible for the processor modules and/or the memory modules of the lighting units to be provided by way of a centralised processor module and/or a centralised memory module that are located in only one of the lighting units within the group, or, in an entirely separate device to each of the lighting units. In such alternate configurations, the centralised processor module and/or memory module would be operably connected to each of the lighting units in the group via a wired or wireless communication link so as to provide centralised functionality for each of the lighting units.

The illumination modules (230) of the lighting units (200A,200B,200C,200D) can comprise any suitable type of lighting technology however in this embodiment is comprised by a combination of an RGB, white light LED lighting, and brightness dimming modules configured to output a range of colour temperatures, white light components, and brightness characteristics defined by data code sequence representing the sequential steps of the dynamic lighting scene.

By way of example, in this embodiment, the communication module (210) of each of the lighting devices (200A, 200B,200C,200D) comprises a Wi-Fi protocol compatible communication module whereby the control unit is able to communicate control signals to the lighting units via a Wi-Fi router. In alternate embodiments of the present invention wireless communication to and from the lighting units (200A, 200B, 200C) may instead be effected using a Bluetooth, Infrared, or other suitable radio frequency signaling protocol. In yet alternate embodiments, it is possible that communication between the lighting units and external devices such as the control unit may even be implemented via a wired communication link if so desired.

The memory modules (220) of the lighting units (200A, 200B. 200C,200D) may include for instance a flash memory module (220) for storing the data code sequence and program code. The data code sequence represents different RGB, white light and brightness characteristics associated with each of the sequential steps comprising the at least one dynamic lighting scene. The program code comprises computer readable instructions that are executable by the processor module (240) so as to operably control the illumination module (230) to output the lighting characteristics of the steps of the dynamic lighting scene as defined by the data code sequence of the dynamic lighting scene. The memory modules (2230) of the lighting units (200A,200B,200C, 200D) will typically store a plurality of different data code sequences representing a variety of different dynamic lighting scenes so that the user has the flexibility to select a suitable dynamic lighting scene to be output depending upon the specific mood and requirements of the user. The data code sequences and program code may be pre-programmed into the memory modules (220) at the time of manufacture, and/or, may be automatically or manually downloadable into the memory modules (220) from for instance a remote server in communication with the lighting units (200A,200B,200C, 200D) via their communication modules (210). Advantageously, this allows for new data code sequences representing newly created dynamic lighting scenes to be shared into the lighting units (200A,200B,200C,200D) so that the user is presented with an even broader range of available selections over time.

In this embodiment, the plurality of lighting units (200A, 200B,200C,200D) are configured to process the same data code sequence (250) representing the same dynamic lighting scene selected by the user so that the respective illumination modules output the dynamic lighting scene together. In particular, when the user enters a selection into the control device (300) and the control device (300) communicates the selection to each of the plurality of lighting units (200A, 200B,200C,200D) via the wireless communication link. Each of the plurality lighting units (200A,200B,200C,200D) will receive the control input (300) via their respective communication modules (210), and responsive to the received control input, the respective processor modules (240) of the lighting units (200A, 200B, 200C,200D) will execute the program code stored in the respective memory modules (220) so as to process the data code sequence representing the dynamic lighting scene selected by the user. In this embodiment, the plurality of lighting scenes are also configured to output the selected dynamic lighting scene in a non-synchronous manner whereby they each commence outputting the selected dynamic lighting scene at different and/or random steps in the sequence of steps comprising the dynamic lighting scene. Preferably, the randomness results in each lighting unit (200A, 200B, 200C,200D) commencing outputting of the dynamic lighting scene at different steps in the sequence. The determination as to which step in the sequence each lighting unit commences outputting of the dynamic lighting scene can for instance be achieved by the executable program code being configured to assign numerical values to each of the steps in the dynamic lighting scene and then randomly picking the starting step for each lighting unit by reference to numerical values output by a pseudo-random number generator algorithm. Alternately, the control unit (300) may include a processor module configured for randomly determining different steps of the sequence at which each of the plurality of lighting units will commence outputting the dynamic lighting scene in a non-synchronous manner. The processor module (310) of the control unit (300) may also utilise a pseudorandom number generator algorithm to randomly make this determination. Thereafter, when the control unit (300) wirelessly communicates a control instruction code (350) identifying the dynamic lighting scene selected by the user to each of the plurality of lighting units (200A, 200B, 200C,200D), the control instruction code (350) may also be encoded with instructions to each of the plurality of lighting units (200A, 200B, 200C,200D) as to the steps at which each of the lighting units is to commence outputting of the dynamic lighting scene, as randomly determined by the control unit (300). Each of the plurality of lighting units (200A, 200B, 200C, 200D) will typically have a unique identifier code such as a MAC address associated therewith and the control unit is able to encode control instructions directed to each of the plurality of lighting units (200A, 200B, 200C,200D) in a single transmitted control signal by referencing the unique identifier codes of each of the lighting units (200A, 200B, 200C,200D).

The program code is further configured to randomise the manner in which one or more output parameters of each step in the sequence of the selected dynamic lighting scene is output.

For instance, the program code may be configured to randomly vary at least one of the following output parameters of each step in the sequence:

(i) whether the step is output by the illumination modules or skipped over;

(ii) the duration of time each step in the sequence is output by the illumination modules; and (iii) the duration time of transition from one step to the following step in the sequence that is output by the illumination modules.

Figure 6A:
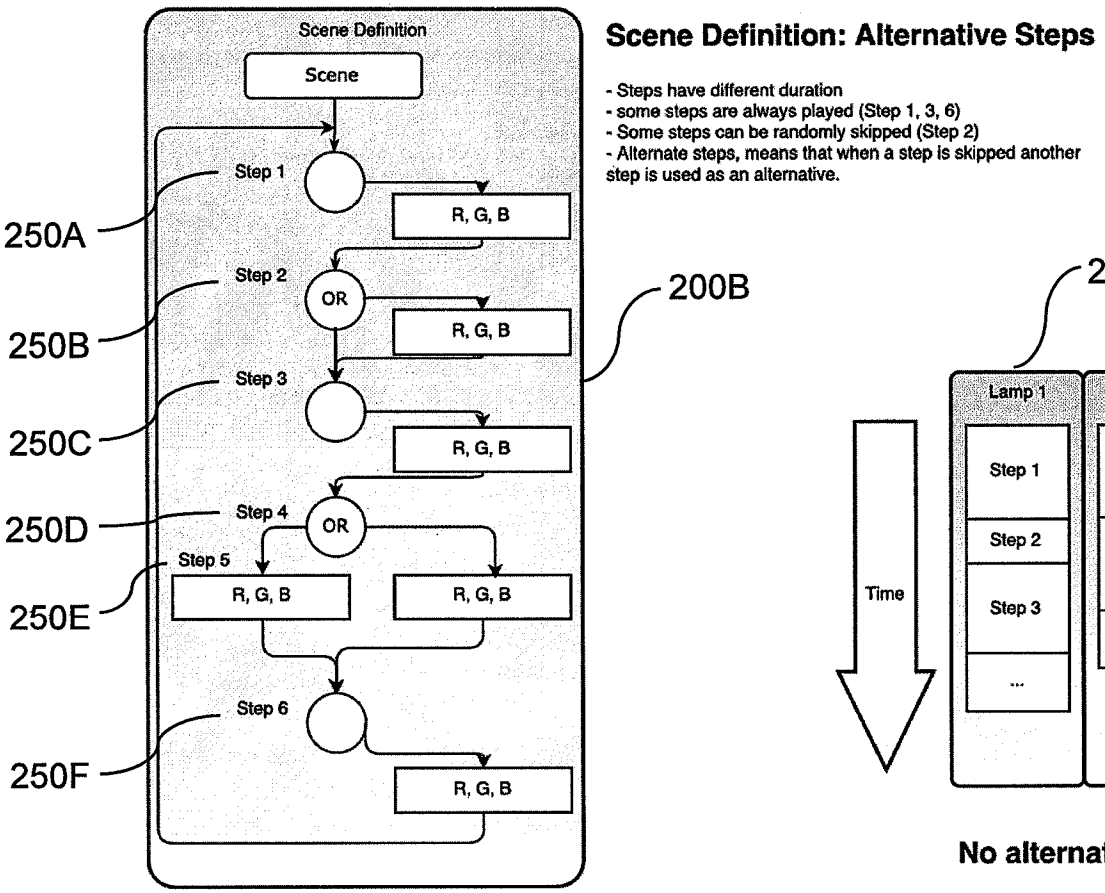
FIGS. 6A-6C shows a representation of another example process flow of a sequence of steps defining a lighting dynamic lighting scene whereby the same sequence of steps of the lighting scene are processed by each of a plurality of lighting units in a non-synchronous and randomised manner, in accordance with an embodiment of the present invention.
Figure 6B:
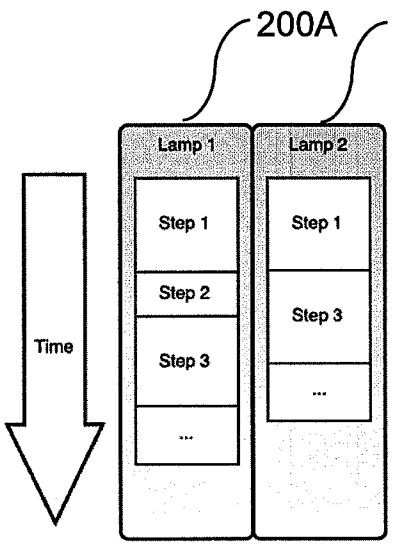
Figure 6C:
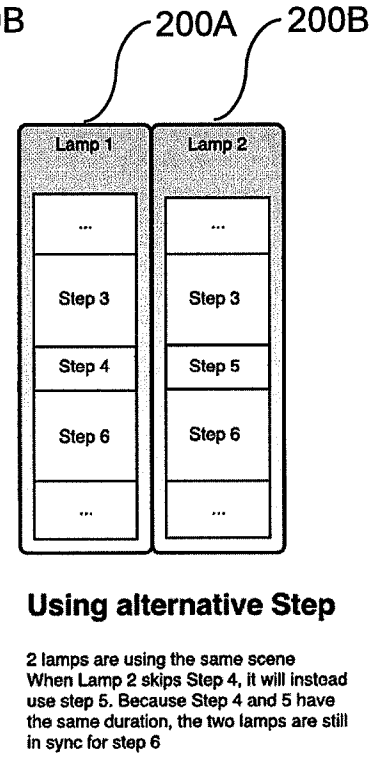

Again, the randomisation of the above exemplary output parameters of each of the steps can be achieved using a pseudorandom number generator algorithm implemented by the processor modules (230) of the respective lighting units (200A,200B,200C,200D) whereby the parameters are variable by reference to the random values generated by the algorithms. The randomness of each of the above output parameters may be predefined into the program code executable by the respective processor modules (230) of each of the lighting units (200A,200B,200C). Referring to FIG. 6A, an example of the process flow and random output of steps of a dynamic lighting scene is shown whereby the data code sequence (250) comprises 6 steps (250A-250F) each of which may be randomly output by the lighting unit (200B). In this example representation, as shown in FIG. 6B, after step 1 (250A) has been randomly output by the illumination module of lighting unit (200B), step 2 (250B) is randomly skipped over for output by lighting unit (200B) whereby step 3 (250C) is randomly output instead. In contrast, a different lighting unit (200A) in the group randomly outputs step 2 (250B). Similarly, as shown in FIG. 6C, after step 3 (250C) has been output by the illumination module of lighting unit (200B), step 4 (250D) is randomly skipped over by lighting unit (200B) whereby step 5 (250E) is randomly output instead. In contrast, lighting unit (200A) in the group randomly outputs step 4 (250D) but randomly skips over outputting step 5 (250E) instead. Advantageously, the randomisation of the output parameters associated with each step of the dynamic lighting scene may assist in creating a more immersive and pleasant visual rendering of the dynamic lighting scene for the user than compared to the relatively repetitive and predictable manner in which the sequential steps in a dynamic lighting scenes are rendered by existing systems.

Figures 5A, 5B, 5C:
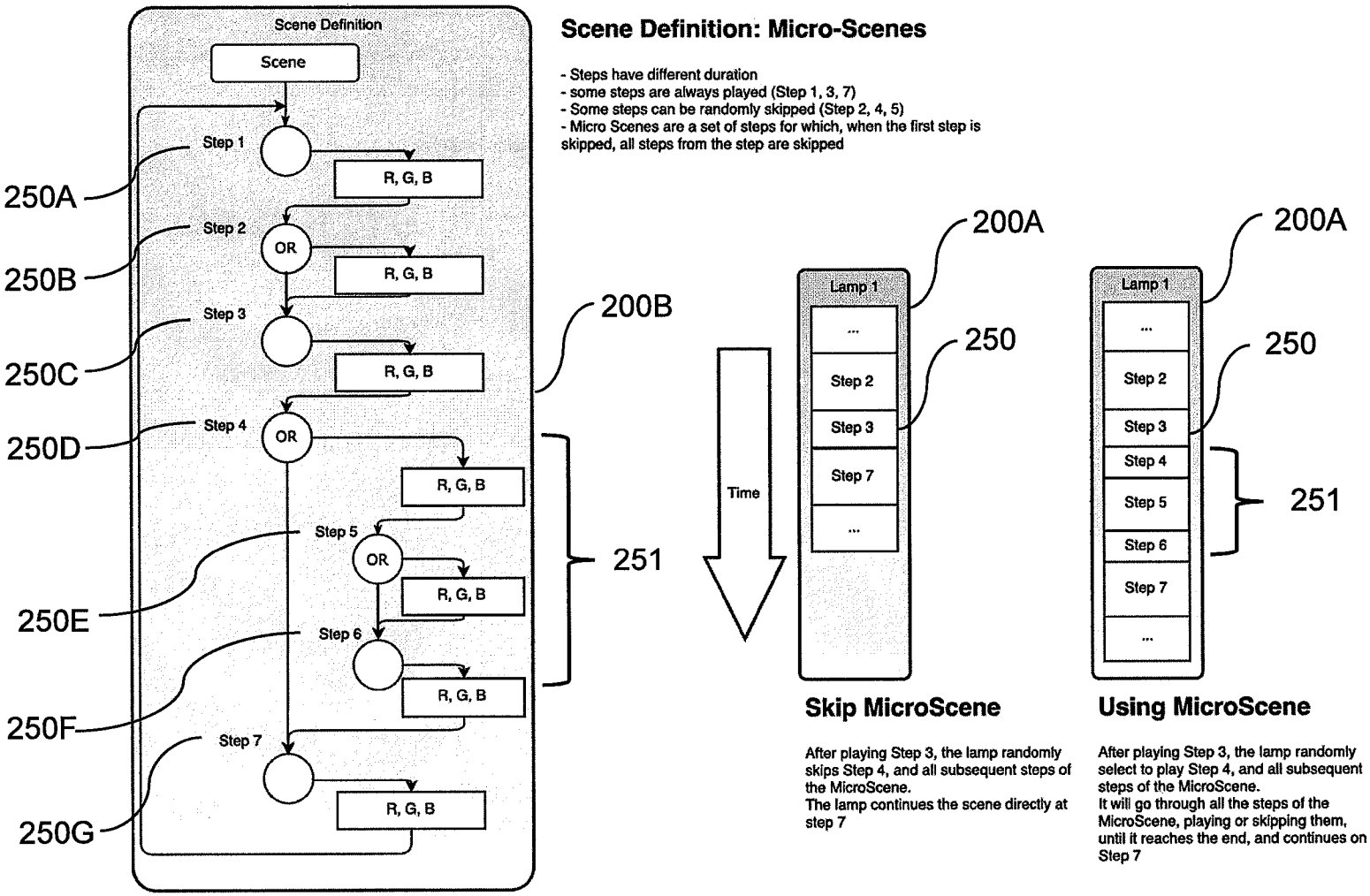
FIGS. 5A-5C shows a representation of an example process flow of a sequence of steps defining a lighting dynamic lighting scene whereby the same sequence of steps of the lighting scene are processed by each of a plurality of lighting units in a non-synchronous and randomised manner, in accordance with an embodiment of the present invention.

In this embodiment, the dynamic lighting scenes may include one or more "micro-scenes"—that is, a predefined group of sequential steps within the dynamic lighting scene. Micro-scenes are designed so that the combined output of the associated steps when output sequentially by the illumination modules (240) may simulate a particular effect—for instance, a dramatic flash of lighting. The program is configured so that when a first step of a micro-scene is randomly skipped over by the program, the program is configured to also automatically skip over all other steps pre-defined in the micro-scene and to output the next step immediately following the steps in the micro-scene. Conversely, when the first step in the micro-scene (251) is randomly output by the program, all other steps in the micro-scene are also then automatically output by the program. This ensures that a micro-scene is not partially output by the illumination module which can be non-aesthetically pleasing for the user. Referring to FIG. 5A, an example micro-scene (251) is shown comprised of a pre-defined grouping of 3 steps—that is, the micro-scene (251) comprises steps 4 (250D), 5 (250E) and 6 (250F) within the data code sequence (250) comprising an overall 6 steps (250A-250G). FIG. 5B shows an example of where the lighting unit (200A) has randomly skipped over the first step (i.e. step 4 (250D)) of the micro-scene and consequently, the processor module of the lighting unit (200A) is configured to automatically skip over all other remaining steps 5 (250E) and 6 (250F) of the micro-scene (251). Conversely, as shown in FIG. 5C, where the lighting unit (200A) has randomly outputted the first step (i.e. step 4 (250D)) of the micro-scene (251), consequently, the processor module of the lighting unit (200A) is configured to also automatically output over all other remaining steps 5 (250E) and 6 (250F) of the micro-scene (251).

In this embodiment, the control unit (3) could comprise for example an application specific remote control device, a smartphone, a tablet device or a personal computer having an input user interface (330), a memory module (320), a processor module (310) and a wireless communication module (340) operably-connected together. The user input interface (330) may typically include a touchscreen electronic display module (340) which is configured to display a menu listing of predefined dynamic lighting scenes entries thereon. The user may select any one of the predefined dynamic lighting scenes from the menu listing by effecting touch interaction with the appropriate entry in the menu listing on the display screen. The processor module (310) of the control unit (300) is then configured to transmit a control signal instruction to the lighting units (200A,200B,200C, 200D) which is indicative of the selected menu entry. It is of course possible in alternate embodiments for the input user interface (3330) to be a separate input device such as a physical keypad, touchpad or mouse type device interface.

A software application module is downloadable into the memory module (320) of the control unit (300) from an online computer server via the communication network and is executable by the processor module (310) of the control unit (300) to provide a graphical user-interface (330) operable on the touchscreen electronic display module (330) via which a user may be able to at least provide various user-interactive control. It would be understood that in alternate embodiments of the present invention the various user-interactive control provided by the software application module may be implemented by embedded software disposed in the hardware itself or any other suitable hardware technology. The software application module is further configured to allow operable connection with each of the lighting units (200A,200B,200C,200D) in the communication network via respective communication modules (210) of each of the lighting units (200A,200B,200C,200D), to recognise each of the lighting units (200A,200B,200C, 200D) by reference to their respective unique identifiers, and to control operation of each of the lighting unit settings of each of the lighting units (200A,200B,200C,200D).

Figure 1:
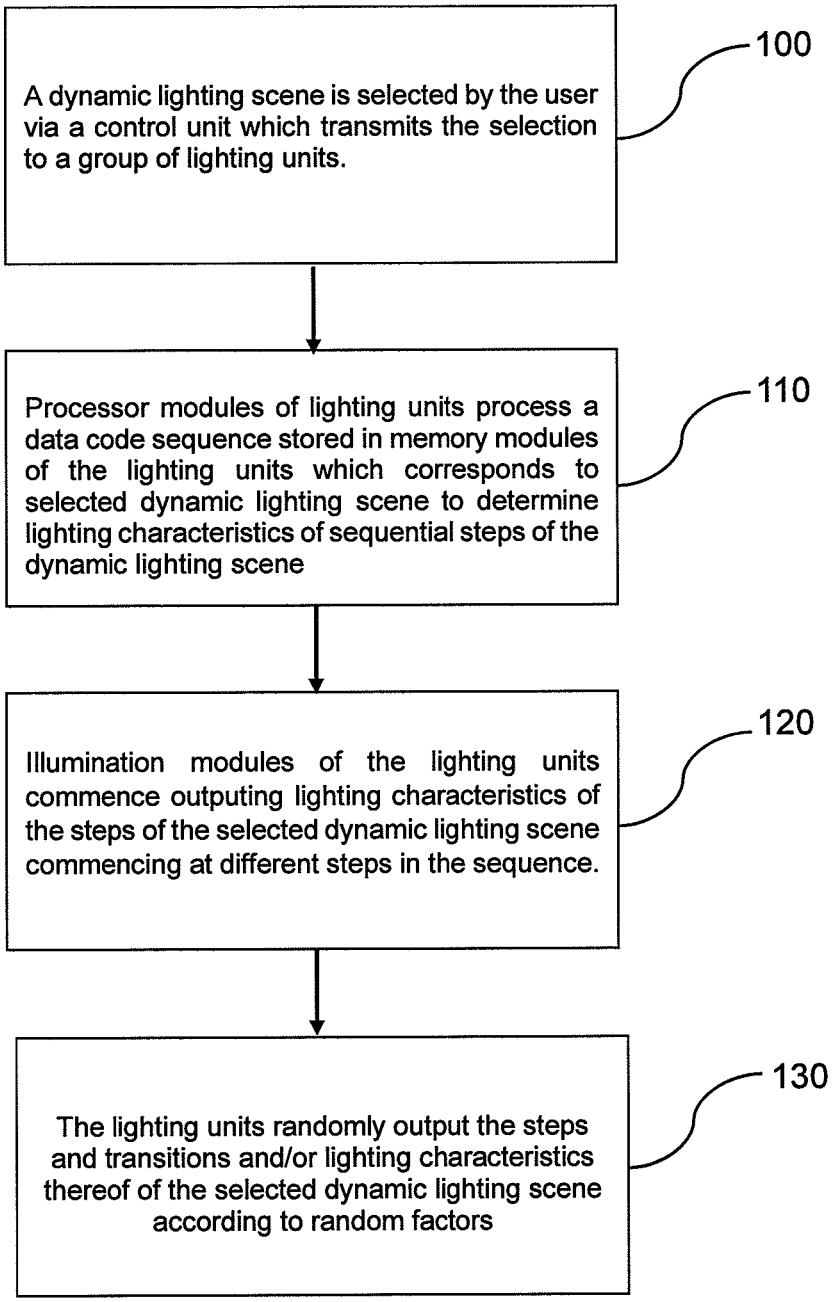
FIG. 1 shows a flow-diagram of method steps in accordance with one embodiment of the present invention.

In accordance with a further embodiment of the present invention, exemplary method steps (100)-(130) are shown in the flowchart of FIG. 1 for outputting a dynamic lighting scene by a group of lighting units, whereby the method steps are broadly as follows:

(i) in accordance with method step (100), a dynamic lighting scene is selected for output by a group of lighting units by the user via a control unit which transmits the encoded selection wirelessly to a group of lighting units;

(ii) in accordance with method step (120), processor modules of the lighting units process a data code sequence stored in memory modules of the lighting units which corresponds to the selected dynamic lighting scene whereby the processor modules are able to determine the lighting characteristics of the sequential steps of the dynamic lighting scene to be output;

(iii) in accordance with method step (130), illumination modules of the lighting units commence outputting the lighting characteristics of the steps of the selected dynamic lighting scene commencing at different steps in the sequence so as to be non-synchronous; and (iv) in accordance with method step (140), illumination modules of the lighting units randomly output the steps and transitions and/or lighting characteristics thereof of the selected dynamic lighting scene according to random factors.

Any one of the functional modules of the embodiments described herein may be implemented by way of software for execution by various types of processors. Executable code may, for instance, comprise one or more physical or logical blocks of computer instructions which may, for instance, be organised as an object, procedure, function, or algorithm. The identified blocks of computer instructions need not be physically located together, but may comprise disparate instructions stored in different locations which, when joined logically together, comprise the module and achieve the stated purpose for the module. Functional modules of the embodiments may also be implemented as hardware circuitry comprising custom circuits or gate arrays, off-the-shelf semiconductors such as logic chips, transistors, or other discrete components. Functional modules may also be implemented in programmable hardware devices such as field programmable gate arrays, programmable array logic, programmable logic devices or the like. Executable code may comprise a single instruction, multiple instructions, and may be distributed over several different code segments, among different programs, and across several discrete memory devices. Similarly, operational data may be identified and illustrated herein within devices, units, and the like and may be embodied in any suitable form and organised within any suitable type of data structure. The operational data may be collected as a single data set, or may be distributed over different locations including over different storage devices, and may exist, at least partially, merely as electronic signals on a system or network.

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

What is claimed is:

1. A system for controlling output of a dynamic lighting scene by a first and a second lighting unit within a common lighting area, the system comprising:

at least one memory module for storing a data code sequence representing pre-defined lighting characteristics associated with a plurality of sequential steps of the dynamic lighting scene;

at least one processor module configured for processing the data code sequence to determine from the data code sequence the lighting characteristics associated with the plurality of steps; and each of said first and second lighting units comprising an illumination module configured for outputting the lighting characteristics associated with the plurality of steps of the dynamic lighting scene as determined by the at least one processor module, and wherein, the illumination modules of the first and second lighting units are configured for outputting the lighting characteristics of the plurality of steps of the dynamic lighting scene in a non-synchronous manner; and wherein at least one of the illumination modules of the first and second lighting units are configured for outputting the lighting characteristics associated with the steps in the sequence of steps of the dynamic lighting scene in a randomized manner, and wherein:

(i) the illumination modules of the first and second lighting units are configured to randomly skip over at least one of the steps in the sequence of steps of the dynamic lighting scene during outputting of the dynamic lighting scene; and/or (ii) the illumination modules of the first and second lighting units are configured to randomly vary the time duration of output of at least one of the steps in the sequence of steps of the dynamic lighting scene; and/or (iii) the illumination modules of the first and second lighting units are configured to randomly vary the time duration of output of at least one transition between sequential steps of the dynamic lighting scene.

2. The system as claimed in claim 1 wherein the illumination modules of the first and second lighting units are configured for outputting the dynamic lighting scene commencing at different steps in the sequence of steps of the dynamic lighting scene.

3. The system as claimed in claim 1 wherein at least a first and a second sequential step in the sequence of steps of the dynamic lighting scene are associated together and wherein:

(i) when the first step is randomly skipped over during outputting of the dynamic lighting scene, the illumination modules of the first and second lighting units are configured to also skip over output of the second sequential step associated with the first step; and (ii) when the first step is randomly output during outputting of the dynamic lighting scene, the illumination modules of the first and second lighting units are configured to also output the second sequential step associated with the first step is also automatically output.

4. The system as claimed in claim 1 wherein the illumination modules of the first and second lighting units include at least one of a colored LED, a white light LED, and a brightness dimming module configured for outputting the lighting characteristics associated with the plurality of steps of the dynamic lighting scene.

5. The system as claimed in claim 1 wherein each of the first and second lighting units comprises one of the at least one processor modules, and/or wherein each of the first and second lighting units comprises one of the at least one memory modules.

6. The system as claimed in claim 1 wherein the at least one memory module is configured for storing a plurality of data code sequences each representing pre-defined lighting characteristics associated with a plurality of sequential steps of a plurality of different dynamic lighting scenes that are able to be outputted by the illumination modules of the first and second lighting units.

7. The system as claimed in claim 6 including a control unit configured for controlling the illumination modules of the first and second lighting units to selectably output one of the plurality of dynamic lighting scenes represented by one of the plurality of data code sequences stored in the at least one memory module.

8. The system as claimed in claim 7 wherein the control unit is configured for controlling the illumination modules of the first and second lighting units by communicating a wireless control signal to at least one of the first and second lighting units via a wireless communication link, the wireless control signal including information indicative of one of the plurality of dynamic lighting scenes selected to be output.

9. A method of controlling output of a dynamic lighting scene by a first and a second lighting unit within a common lighting area, the method comprising steps of:

(i) storing a data code sequence representing pre-defined lighting characteristics associated with a plurality of sequential steps of the dynamic lighting scene in at least one memory module;

(ii) using a processor module to process the data code sequence to determine from the data code sequence the lighting characteristics associated with the plurality of steps; and (iii) outputting the lighting characteristics associated with the plurality of steps of the dynamic lighting scene as determined by the at least one processor module via illumination modules of each of said first and second lighting unit;

wherein, the illumination modules of the first and second lighting units are configured for outputting the lighting characteristics of the plurality of steps of the dynamic lighting scene in a non-synchronous manner, and wherein at least one of the illumination modules of the first and second lighting units are configured for outputting the lighting characteristics associated with the steps in the sequence of steps of the dynamic lighting scene in a randomized manner, wherein:

(i) the illumination modules of the first and second lighting units are configured to randomly skip over at least one of the steps in the sequence of steps of the dynamic lighting scene during outputting of the dynamic lighting scene; and/or (ii) the illumination modules of the first and second lighting units are configured to randomly vary the time duration of output of at least one of the steps in the sequence of steps of the dynamic lighting scene; and/or (iii) the illumination modules of the first and second lighting units are configured to randomly vary the time duration of output of at least one transition between sequential steps of the dynamic lighting scene.

10. The method as claimed in claim 9 wherein the illumination modules of the first and second lighting units are configured for outputting the dynamic lighting scene commencing at different steps in the sequence of steps of the dynamic lighting scene.

* * * * *